US005421182A

United States Patent [19]

Rieck et al.

[11] Patent Number: 5,421,182

[45] Date of Patent: Jun. 6, 1995

[54] TELESCOPING DIE FOR TUBE BENDING

[75] Inventors: Gerald C. Rieck, Sterling Heights; Antoni J. Malarz, Troy, both of Mich.

[73] Assignee: General Motors Corporation, Detroit, Mich.

[21] Appl. No.: 225,102

[22] Filed: Apr. 8, 1994

[51] Int. Cl.[6] ..... B21D 7/08

[52] U.S. Cl. ..... 72/168; 72/428

[58] Field of Search ..... 72/151, 155, 157, 166, 72/168 C, 307, 369, 428, 133

[56] References Cited

U.S. PATENT DOCUMENTS

| | | | |
|---|---|---|---|
| 3,930,393 | 1/1976 | Eppler | 72/133 |
| 4,098,106 | 7/1978 | Yamaguchi | 72/128 |
| 4,254,649 | 3/1981 | Cervenka et al. | 72/128 |
| 4,391,116 | 7/1983 | Yogo | 72/168 |
| 4,412,442 | 11/1983 | Kawanami et al. | 72/369 |
| 4,495,788 | 1/1985 | Traub | 72/157 |
| 4,563,927 | 1/1986 | Kinsley | 83/319 |
| 4,694,718 | 9/1987 | Kinsley | 83/319 |
| 4,989,435 | 2/1991 | Kaneko | 72/166 |
| 5,031,291 | 7/1991 | Shimokata | 29/33 T |
| 5,239,850 | 8/1993 | Shimokata | 72/168 |

*Primary Examiner*—Lowell A. Larson
*Assistant Examiner*—Rodney A. Butler
*Attorney, Agent, or Firm*—Jeffrey A. Sedlar

[57] ABSTRACT

A telescoping die for use in place of a conventional fixed die in a multi-axis tube bender. The telescoping die provides a means of automatically varying the distance to the moveable die thereby increasing the range of possible bend radii that can be formed while maintaining a close positioning between the feed mechanism and the telescoping die.

5 Claims, 3 Drawing Sheets

TELESCOPING DIE FOR TUBE BENDING

BACKGROUND OF THE INVENTION

The present invention relates to multi-axis tube bending. More particularly, the invention is directed to the dies used in a multi-axis tube bender.

Multi-axis tube benders provide a precise means for continuously bending a curvature into a metal tube as it moves through the bender along an X-axis. Benders generally include a fixed die and a moveable die axially spaced from the fixed die along the X-axis. Each die closely surrounds the exterior cross-section of the tube being bent. A powerful feed mechanism with a pushing tool forces the tube through both dies. As the tube moves through the dies, the moveable die swings through a preprogrammed set of motions relative to the fixed die to bend the tube into a desired curvature.

The fixed die is so-called due to the fact that it is generally rigidly attached to the machine base and its position is only changed during set up of the machine. During set up, the fixed die is positioned to suit the range of radii that will be bent for the specific part to be formed. The moveable die is generally capable of being positioned in two translation directions perpendicular to the direction the tube being bent is moving along the X-axis. A moveable die is generally also capable of rotating about three axial directions.

The axial distance along the X-axis between the fixed die and the moveable die, having been predetermined and locked in during set up of the machine, acts to limit the possible variations in bend radii that can be produced. This distance is a factor in controlling the radius of the bend that is formed in the tube by each movement of the moveable die. Generally, in order to adjust the distance along the X-axis between the two dies, the machine must be taken out of operation and the fixed die relocated. Therefore, the only time the distance between the fixed and moveable die is changed is when an adjustment is being made to run a particular part during machine set up.

It is desirable to provide a machine that is capable of producing a maximum range of bend radii in a part being formed while at the same time providing adequate support for the tube along the X-axis to prevent the tube being formed from buckling or kinking.

SUMMARY OF THE INVENTION

To maximize the range of bend radii that can be imparted to a workpiece the present invention provides a fixed die having a telescoping capability. The resultant telescoping die includes a stationary part mounted to the bender and a positionable part moveable to vary the distance between the telescoping die and the moveable die. Including a positionable part on the telescoping die provides the benefit of being able to make adjustments in the radius of the bend as it is being formed in the workpiece while producing a higher quality product. This also makes greater variations in bend radii possible. The telescoping die is particularly useful in forming tight radius bends.

The positionable part of the telescoping die preferably includes a means of automatic adjustment that provides a mechanism for varying the distance between the telescoping and moveable dies while the machine is operating. These types of adjustments are commonly termed "on-the-fly" adjustments.

By providing a telescoping die in the place of a typical fixed die, the stationary part of the die can remain positioned in close proximity to conventional tube support casings on the feed end of the die while the positionable part can be selectively relocated. This provides a means of avoiding a situation where the potential for the tube to bulge or buckle in the unsupported gap between the support casing and the telescoping die is created. The proximate location of the stationary part to the support casing also aids in maintaining alignment between the pushing tool and the tube, which is particularly beneficial with thin walled tube material. Additionally, the positionable part of the die provides a means for forming a broader range of bend radii in the tube, within which an infinite number of adjustments may be made.

In operation, a conventional bending machine will generally be provided with a pushing tool to move the tube being bent through the dies. The leading end of the tube being pushed initially travels through the support casings and then into the telescoping die. In accordance with the invention, the gap between the support casings and the stationary part of the telescoping die can be maintained at a dimension optimal to preventing bulging or buckling in the gap. While in the telescoping die, the tube moves through the stationary part and the telescoping part. The two parts include a telescoping means that provides support for the tube so that it is adequately supported during its entire travel through the telescoping die. As the tube leaves the positionable part of the telescoping die, it travels through the space between the telescoping die and the moveable die and then into the moveable die.

Once a tube extends through both dies and while travelling through the space therebetween, the tube is bent into a predetermined radius by movement of the moveable die. By providing the positionable part of the telescoping die with a means of on-the-fly adjustment while the machine is running, the bend can be adjusted to provide a greater range and selection of radii.

It is therefore, a general object of the invention to provide a tube bender having dies capable of producing higher quality parts. The invention is directed to providing a telescoping die capable of being adjusted while the machine is running, thereby increasing the range of bend radii that can be accurately formed in a tube. The invention is also directed to avoiding unsupported gaps between the support casings and the telescoping die and throughout the telescoping die. These objects along with other advantages are provided by the telescoping die as described in the following detailed description.

DETAILED DESCRIPTION OF THE PRESENTLY PREFERRED EMBODIMENT

Figure 1:
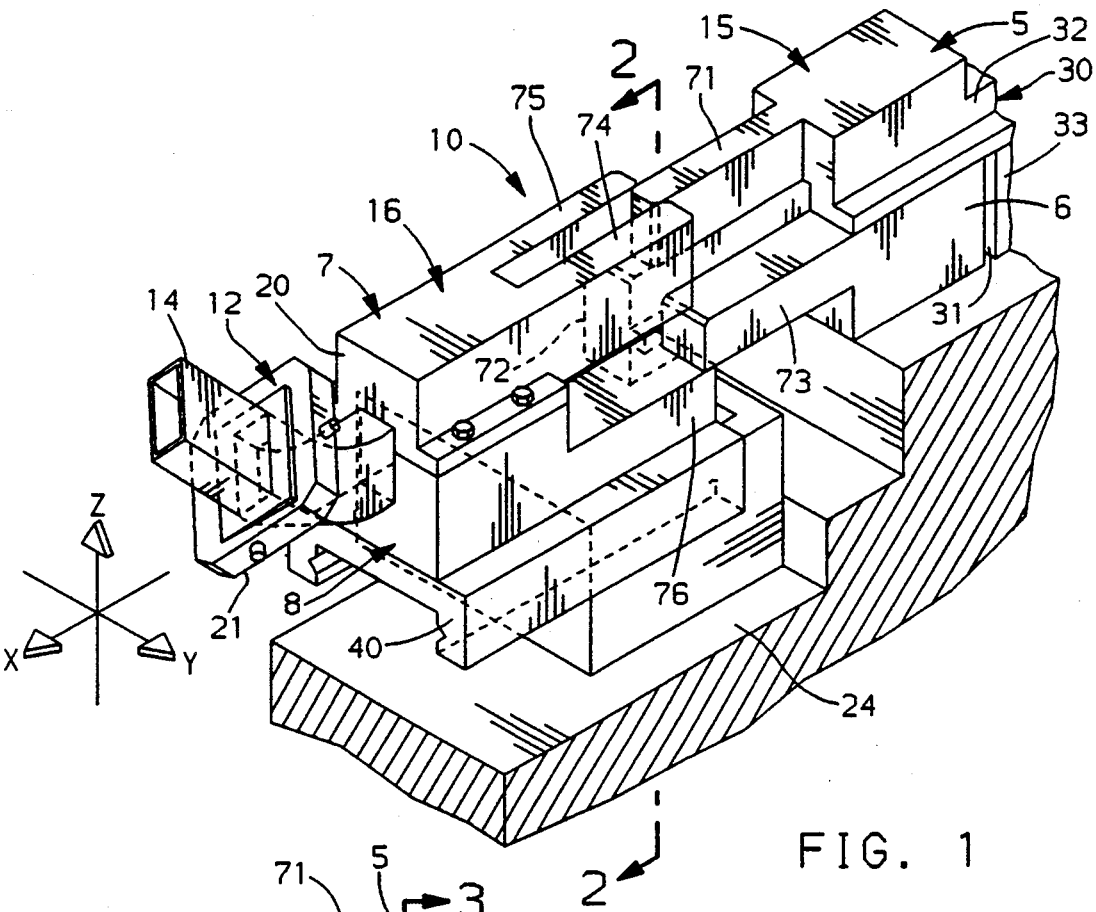
FIG. 1 is a perspective view of the telescoping and moveable dies of a multi-axis tube bending machine.

Referring to FIG. 1, the die area of a multi-axis tube being machine is illustrated. A telescoping die 10 and a moveable die 12 are shown. The moveable die 12 is supported for preprogrammed motion by a complex series of yokes which are not illustrated for purposes of simplicity. In operation a series of bends can be formed along the length of a section of tubing 14 through the cooperation of the telescoping die 10 and the moveable die 12. The tube 14 is bent into a predetermined curvature within the axial space between the telescoping die 10 and moveable die 12. During a forming cycle the tube 14 is pushed through the dies 10 and 12, by a stock pusher (not illustrated).

As the tube 14 reaches various points along its length where a bend is required, the moveable die 12 can be moved about three axes of rotation and can be translated in two axes. The two axes of translation include a Y-axis in a horizonal direction perpendicular to the flow of the tube and the Z-axis in the vertical direction which is also perpendicular to the flow of the tube. Translation of the moveable die in the X-axis, which is the axis along the center line of the moving tube 14 is generally not provided.

The distance between the trailing end 20 of the telescoping die 10 and the leading end 21 of the moveable die 12 is generally open. A mandrel (not illustrated) is typically used to internally support the tube 14 through this distance. Changing the location of the trailing end 20 of the telescoping die 10 results in a unique bend radius in the tube 14 by each move of the moveable die 12 for each distance obtained. Therefore, the number of bend radii that can be imparted to tube 14 is multiplied by providing movement in the telescoping die 10.

The telescoping die 10 is comprised of stationary part 15 and positionable part 16. Stationary part 15 is comprised of the upper die 5 and lower die 6. Positionable part 16 is comprised of the connected upper die 7 and lower die 8.

Figure 3:
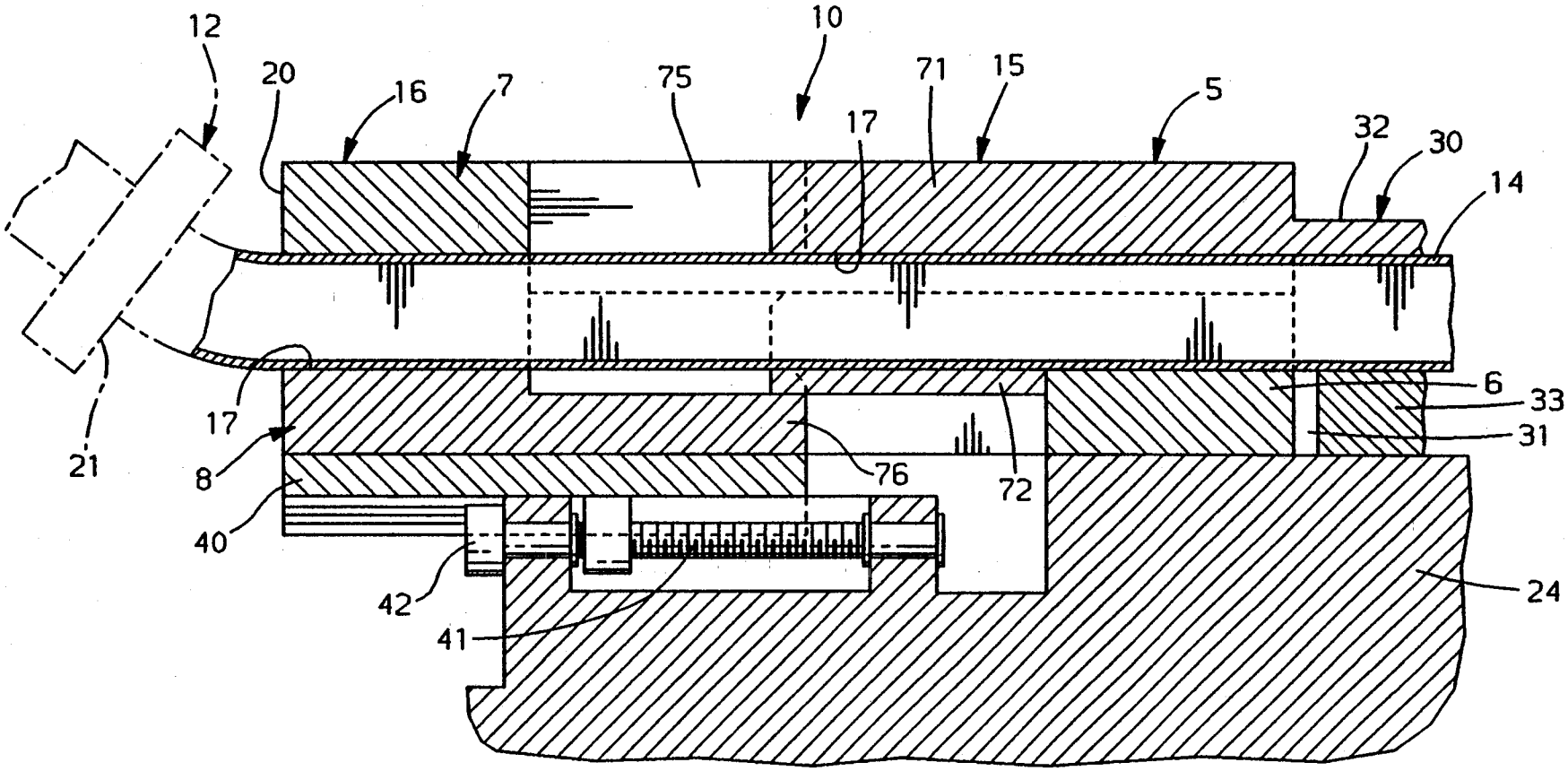
FIG. 3 is a partial, cross-sectional view taken generally along the plane indicated by line 3—3 in FIG. 2.

Referring to FIG. 3 the die area of a multi-axis bending machine is illustrated in cross section. Support casing 30 is shown disposed about the tube 14 at the feed end of the telescoping die 10 and is comprised of a top half 32 and a bottom half 33. The purpose of the feed casing 30 is to prevent the long, slender tube 14 from buckling prior to being pushed through the dies. The top half 32 of feed casing 30 opens to permit the positioning of a tube 14 in the feed mechanism.

If a substantial gap between the support casing 30 and the telescoping die 10 is established during set up of a bender, the potential for the tube 14 to bulge or buckle in the unsupported distance across the gap exists. Therefore, the feed casing 30 is integrated into the feed end of the telescoping die 10 by providing stationary part 15 and forming the top half 32 of feed casing 30 with the upper die 5 of stationary part 15 as a unit. The upper die 5 opens along with the incorporated top half 32 of feed casing 30 for loading a workpiece. Because the die 10 is telescoping, the stationary part 15 does not need to be relocated during bender set-up, making the incorporation of upper die 5 with the top half 32 of feed casing 30 possible. The gap 31 remains between the the bottom half 33 of feed casing 30 and lower die 6.

Also illustrated in FIG. 3 is the slide 40. Slide 40 provides a means for selectively moving the positionable part 16 of telescoping die 10 on the fly. The slide 40 is adjustably positioned by means of ball screw 41. Drive means 42, such as a servomotor, provides rotary motion to ball screw 41 to accurately position slide 40. Means (not illustrated), for automatically controlling actuation of the drive means 42 to position the slide 40 according to selected preprogrammed movements are provided as part of a conventional bender controller.

Other suitable means for moving the slide 40 could be substituted for ball screw 41 to achieve the objects of this invention. For example, a linear drive mechanism could be substituted in place of the ball screw 41 and drive means 42. The device used to selectively position the slide 40 is capable of providing the accuracy required to form the designed bends in tube 14.

The stationary part 15 of the telescoping die 10 is rigidly attached to the machine frame 24 by suitable means such as screws and a thrust key (not illustrated). The positionable part 16 of the telescoping die 10 is similarly mounted to the slide 40 for coordinated movement therewith. The die cavity 17 with a cross section substantially matching the exterior cross section of the tube 14 extends through the stationary part 15 and the positionable part 16 of telescoping die 10 along the X-axis. The cross section of cavity 17 will vary according to the design of each unique part being formed by a bender.

Figure 4:
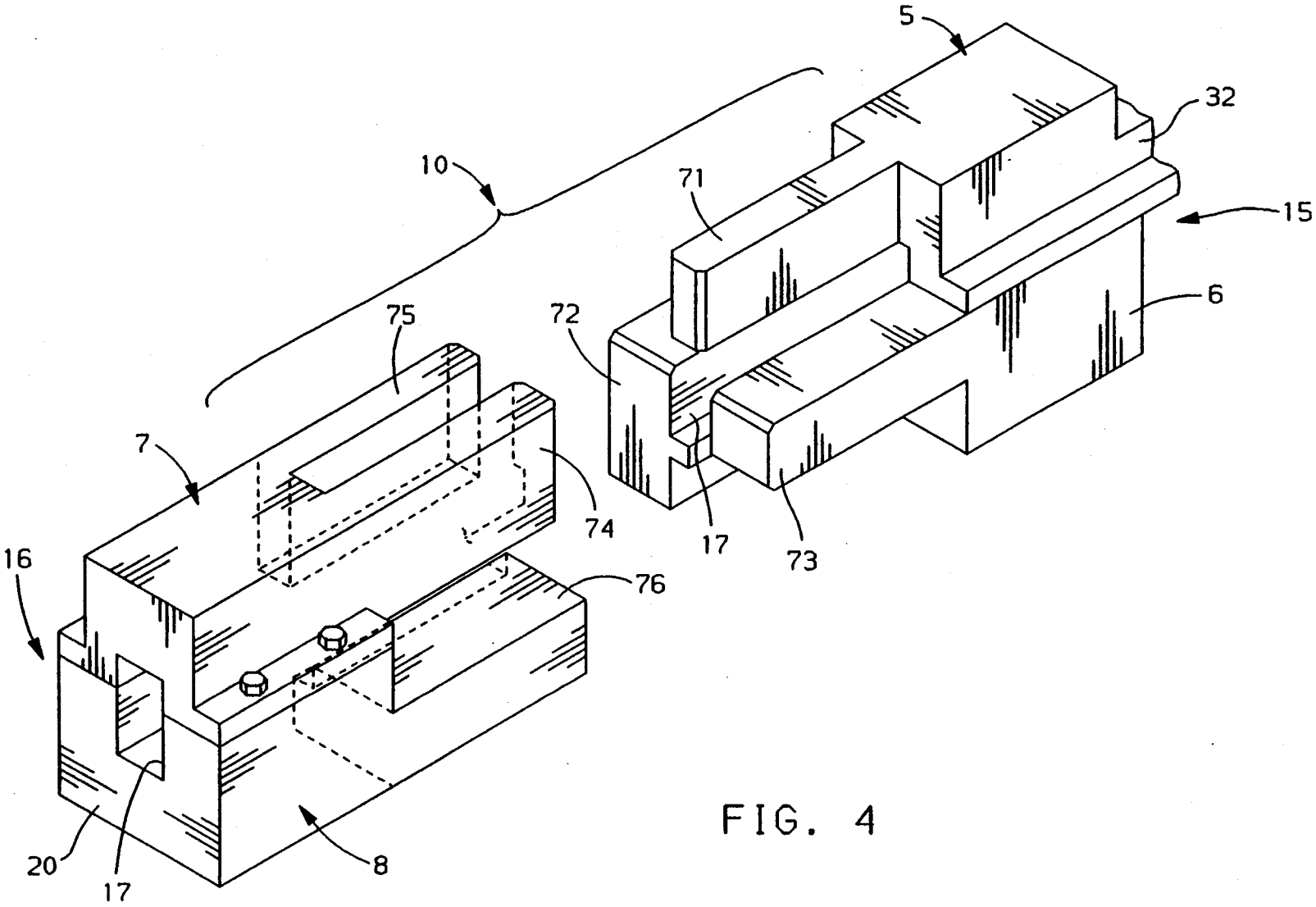
FIG. 4 is an exploded view of a telescoping die.

The telescoping die 10 is sectioned to provide interlocking fingers which are better illustrated in the exploded perspective view of FIG. 4. The stationary part 15 is provided with fingers 71 through 73. Spaces provided between the fingers 71 through 73 mate with the fingers 74 through 76 of the positionable part 16. The fingers 71 through 76 provide a slidable engagement mechanism between the stationary part 15 and the positionable part 16. The fingers supply the preferred mechanism which allows the fixed die 10 to telescope.

When the telescoping die 10 is in a collapsed condition, fingers 71–76 are totally engaged with one another, each nesting in a space formed between the fingers of the mating die part. The interlocking fingers 71–76 cooperate to define a segment of the cavity 17 through the telescoping die 10. When the telescoping die 10 is in an extended condition, all of the fingers are still engaged by a minimum amount. This ensures that support is provided for the tube 14 as it passes through the cavity 17 in the finger area.

The fingers 71–73 cooperate to define a plurality of surfaces surrounding the tube 14 in an alternating arrangement with the surfaces surrounding the tube 14 that the fingers 74–76 define. The telescoping mechanism provided by fingers 71–76 helps to maintain the axial alignment of the positionable part 16 with the stationary part 15 in addition to supporting the tube 14.

An infinitely adjustable relationship between the stationary part 15 and the positionable part 16 is provided in a range between the collapsed condition and the extended condition of the telescoping die 10. In combination with the slide 40 a mechanism is provided which permits on-the-fly adjustment of the distance between the moveable die 12 and the telescoping die 10 along the X-axis. This mechanism significantly increases the number of bend radii that can be produced for a unique tube 14 with a single set up of the bender.

Figure 2:
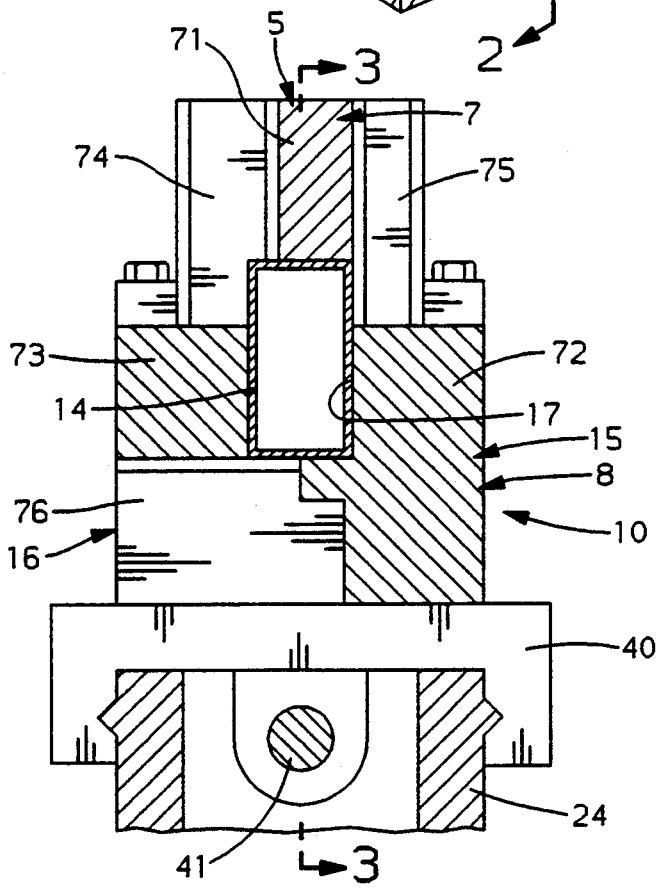
FIG. 2 is a partial, cross-sectional view taken generally along the plane indicated by line 2—2 in FIG. 1.

FIG. 2 illustrates in cross section the interlocking finger area of the telescoping die 10. The interlocking fingers 71–76 provide a segment of the die cavity 17 throughout which the tube 14 is supported. The positionable part 16 is moveable relative to the stationary part 15 because of the slidably interlocking fingers 71–76. Slide 40 engages the machine base 24 to provide stability in the lateral and vertical directions. Sliding in the longitudinal direction along the X-axis is provided to selectively position the positionable part 16 of the telescoping die 10.

The telescoping die 10, as described, is directed toward use in varying the distance between itself and the moveable die 12 while a tube bending operation is being performed. This result is achieved while not creating an excessive unsupported gap between the feed casing 30 of the stock feeding mechanism and the telescoping die 10.

Variations in the disclosed embodiment are possible while still providing the objects of the present invention. The mechanism provided to selectively position the positionable part of the telescoping die can readily be changed. In addition, the means of telescoping engagement provided between the stationary part 15 and the positionable part 16 of the telescoping die 10 could also be varied. A means other than interlocking fingers which slidably engage one another could be provided. The mechanism provided by the fingers is directed to providing a means of support between the stationary part 15 and the positionable part 16 for the tube 14 as it travels through the telescoping die 10. Therefore, a telescoping means such as a stationary central portion around the cavity 17, a series of expandable plates between the two parts, or similarly functioning devices could be used.

What is claimed is:

1. A telescoping die for use in a bending machine having a feed mechanism, a moveable die and an X-axis of motion along which a workpiece is longitudinally translated through the telescoping and moveable dies comprising:

a stationary part for mounting to the bending machine in a fixed location along the X-axis of motion;

a positionable part being variously automatically positionable along the X-axis in relation to the stationary part; and telescoping means between the stationary part and the positionable part for supporting the workpiece between the stationary and positionable part regardless of the position of the positionable part relative to the stationary part.

2. A telescoping die for use in a bending machine having a feed mechanism and a moveable die in which a tube having a predetermined exterior cross section and an X-axis is continuously pushed under force along the X-axis through the axially spaced telescoping and moveable dies in order to continuously bend a curvature into the tube, the telescoping die comprising:

a stationary part having a plurality of fingers fixedly mounted to the bending machine and positioned along the X-axis between the feed mechanism and the moveable die, proximate to the feed mechanism; and a positionable part for positioning between the stationary part and the moveable die having a plurality of fingers interlocking with the fingers of the stationary part in a telescopic relationship, the positionable part being adjustably positionable along the X-axis within a range of infinite positions.

3. The telescoping die according to claim 2 wherein the positionable part is automatically adjustably positionable while the die is being used to bend a curvature into a tube.

4. The telescoping die according to claim 3 wherein the telescoping die includes a feed end fixedly positioned in close proximity to the feed mechanism and a terminal end at the opposite end of the telescoping die from the feed end along the X-axis wherein the terminal end is adjustably positionable along the X-axis to incrementally adjust the degree of bend imparted to the tube while the feed end coincidentally remains permanently, fixedly positioned in close proximity and connected to the feed mechanism.

5. A telescoping die for use in a bending machine having a feed mechanism for feeding a tube of a continuous cross section through the telescoping die and a moveable die to bend the tube into a predetermined configuration by selectively moving the moveable die to determine the radius and location of the bend formed into the tube comprising:

a stationary part attached to the bending machine in a selected location between the feed mechanism and the moveable die in close proximity to the feed mechanism to prevent deformation of the tube from occurring between the feed mechanism and the stationary part and having a plurality of fingers with a plurality of spaces in between the fingers;

a positionable part selectively positionable along a range of infinite positions between the stationary part and the moveable die while the tube is being fed through the telescoping die and moveable die, providing a means in addition to the selective movement of the moveable die to determine the radius of the bend formed into the tube and to bend the tube into a predetermined configuration, the positionable part having a plurality of fingers with a plurality of spaces in between the fingers meshing with the fingers and spaces of the stationary part providing an interlocking, telescoping mechanism between the stationary part and positionable part to support the tube;

means for automatically, selectively positioning the positionable part along the range of infinite positions between the stationary part and the moveable die to adjust the bend radius.

* * * * *